United States Patent [19]

de Polo

[11] 4,158,997

[45] Jun. 26, 1979

[54] TABLE WITH TELESCOPIC AND ROTATABLE TOP

[76] Inventor: Harry R. de Polo, 480 Park Ave., New York, N.Y. 10022

[21] Appl. No.: 848,722

[22] Filed: Nov. 4, 1977

[51] Int. Cl.[2] ..... A47B 9/04

[52] U.S. Cl. ..... 108/95; 108/105

[58] Field of Search ..... 108/103, 105, 95, 96, 108/141; 312/301, 282; 248/161, 407, 415, 418

[56] References Cited

U.S. PATENT DOCUMENTS

| | | | |
|---|---|---|---|
| 793,451 | 6/1905 | Lindsay | 108/103 |
| 955,349 | 4/1910 | O'Brien | 248/407 X |
| 1,250,305 | 12/1917 | Gumprecht | 108/95 |
| 1,666,392 | 4/1928 | Masury | 248/418 |
| 1,994,188 | 3/1935 | Bergman | 108/95 |
| 2,591,726 | 4/1952 | Schoen | 312/301 X |
| 3,469,870 | 9/1969 | Barkus | 108/95 X |

FOREIGN PATENT DOCUMENTS

| | | | |
|---|---|---|---|
| 539885 | 2/1956 | Italy | 248/161 |
| 603581 | 6/1948 | United Kingdom | 248/161 |

*Primary Examiner*—Francis K. Zugel

*Attorney, Agent, or Firm*—Robert E. Burns; Emmanuel J. Lobato; Bruce L. Adams

[57] ABSTRACT

A table suitable for many uses comprises a rectangular prismatic base having a vertical well located near one corner and a rectangular table top having near one corner a downwardly extending supporting post rotatably received in the well of the base and longitudinally slidable therein. A pin projecting inwardly in the well is engageable in a longitudinal slot in the top-supporting post and, when the table top is raised, is engageable with a lower end surface of the post to support the table top in raised position while permitting rotation of the table top relative to the base. The post also has a downward extension at the lower end of which there is provided a notched disc which is also engageable with the inwardly projecting pin of the well to support the table top rotatably at a third height. In another embodiment the base is larger and has wells at opposite sides to receive the supporting posts of four table tops. A storage space in the base is closed by sliding covers which provide additional supporting surfaces.

13 Claims, 13 Drawing Figures

FIG. 9
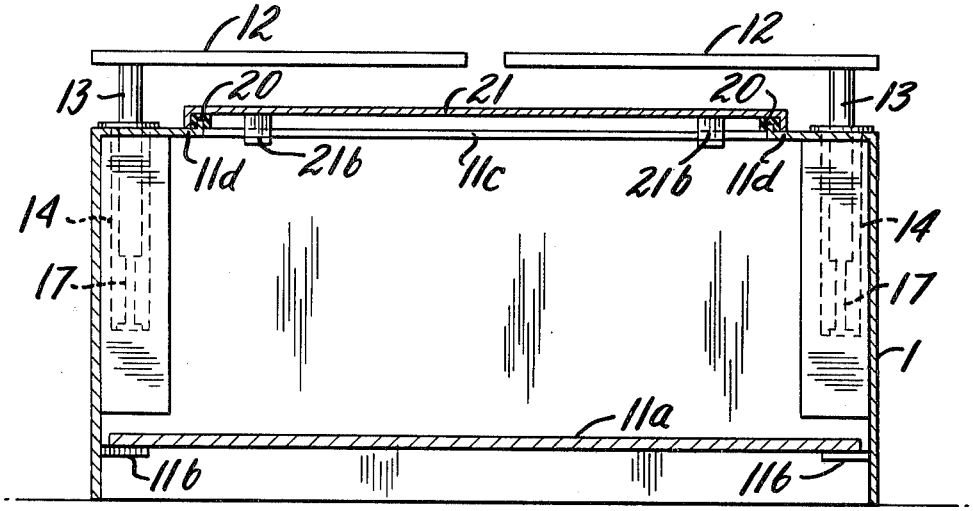
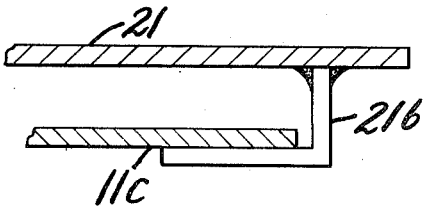
FIG. 10
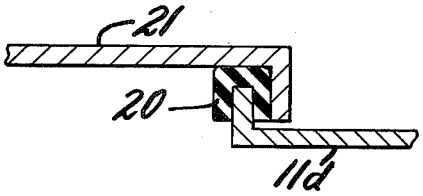
FIG. 11
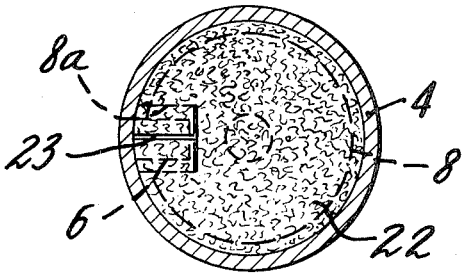
FIG. 12
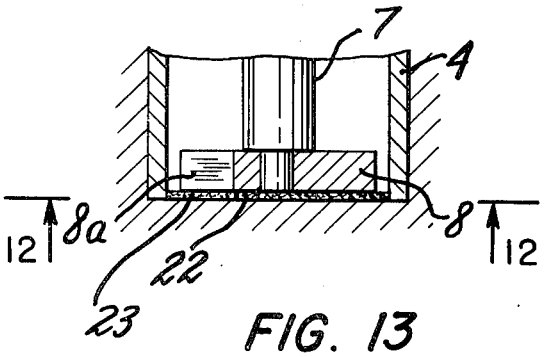
FIG. 13

TABLE WITH TELESCOPIC AND ROTATABLE TOP

FIELD OF INVENTION

The present invention relates to a table comprising a base and one or more table tops telescopically and rotatably mounted on the base. Such tables are suitable for many uses in the house, office, school, hospital and elsewhere, for example as end tables, bedside tables, work tables, coffee tables and buffet or regular dining tables.

BACKGROUND OF THE INVENTION

There are many different kinds of tables. For the most part the top of a table is stationary with respect to the base or legs by which it is supported. However, there have been proposed tables in which the top or a portion of the top is movable with respect to the base or legs. For example there are drop leaf tables, tilt top tables and tables having a top which can be raised or lowered. Such tables, however, are of limited use and leave much to be desired from the point of view of attractiveness of appearance.

SUMMARY OF THE INVENTION

It is an object of the present invention to provide a table having a table top which can readily be positioned at different levels and can be rotated 360° about an eccentric axis into any desired position.

In accordance with the invention, the tables comprises a base having a vertical well located eccentrically of the base and a table top having an eccentrically located downwardly extending supporting post which is rotatably received in the well of the base and is also longitudinally slidable therein so as to position the table top at different heights. The post supporting the table top and the well in the base have cooperating abutment surfaces arranged at different levels and engageable with one another upon angular movement of the table top relative to the base so as to support the table top at different levels relative to the base. These cooperating abutment surfaces permit free rotation of the table top relative to the base at at least one of the selected heights.

In a preferred embodiment of the invention the base has the form of a rectangular prism with the vertical well located near one corner and the table top is rectangular with the downwardly extending supporting post correspondingly located near one corner of the top. In one position, the table top is located directly above the base while in other positions it overhangs the base which has a flat top so as to provide an additional supporting surface. The abutment surfaces provided in the well and on the supporting posts of the table top cooperate to hold the table top against rotation when at its lowermost level while permitting free rotation at higher levels. A downward extension of the post provided with an additional abutment surface permits positioning the table top at any of three or more levels.

A table in accordance with the invention is appropriate for use as an end table or as a bedside table. Moreover, in a coffee table version of the invention, the rectangular base is made larger and wells are provided at opposite sides so as to support four table tops on one base. Moreover, the base is hollow so as to provide a storage space which is closed by slidable covers which provide additional supporting surfaces.

The present invention accordingly provides a table which has wide utility and at the same time is an attractive and ornamental piece of furniture.

BRIEF DESCRIPTION OF DRAWINGS

The nature, objects and advantages of the invention will be more fully understood from the following description of preferred embodiments shown by way of example in the accompanying drawings in which:

FIG. 9 is a cross section taken approximately on the line 9—9 in FIG. 7, and FIGS. 10 and 11 shows details of the table illustrated in FIGS. 7, 8 and 9, FIGS. 12 and 13 show details of a modification.

DESCRIPTION OF PREFERRED EMBODIMENTS

Figure 1:
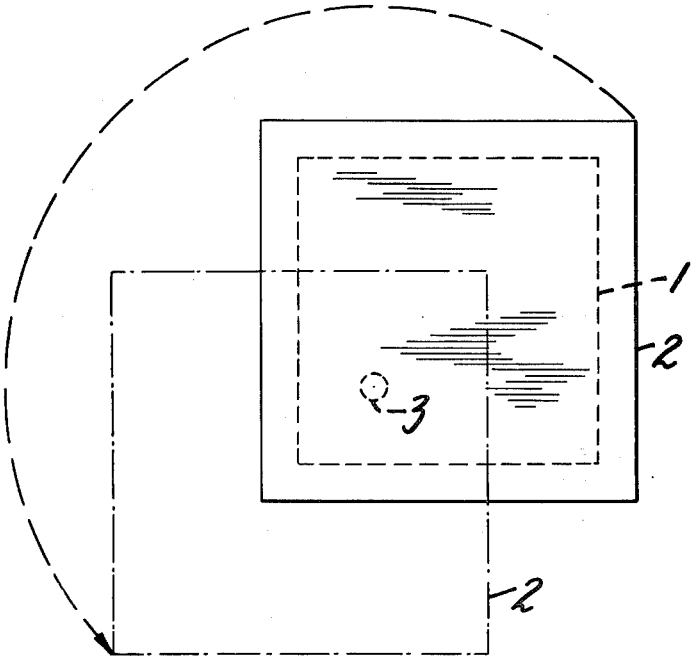
FIG. 1 is a plan view of a table in accordance with the invention with the top shown in one position in solid lines and in another position by broken lines.

The table shown by way of example in FIGS. 1 to 6 comprises a base 1 and a table top 2 supported by a post or column 3 which extends down into a vertical well 4 provided in the base.

The base 1 is shown as a block of rectangular prismatic form which is approximately square in cross section and has a height, somewhat greater than its width, for example 25% greater. The base has a flat top surface 1*a*. The base is formed of any suitable material providing an attractive appearance and having sufficient weight to prevent tipping of the table when the table top is in eccentric overhanging position as shown in broken lines in FIG. 1. Suitable materials are marble, metal, plastic and wood. When a lighter material such as wood is used, the base may be a solid block. It is preferred to use harder and heavier woods such as mahogany and teak. If it is desired to make the base of hollow construction, it may be necessary to add ballast in order to provide sufficient weight. The ballast may, for example, be of such heavy materials as sand or gravel which is preferably bonded for example with plastic so as to retain it in position. If the base is formed of heavier material such as metal it can be made hollow and may or may not require ballast depending on whether the walls and in particular the bottom are of sufficient weight. When ballast is used it should be located at the bottom of the base in order to provide greater stability.

In order to make the table more easily movable, it is supported by four swivelling casters 5 located near the corners of the base. The casters 5 are recessed in recesses 1*b* provided in the bottom of the base so that the base extends virtually to the floor and the casters are hidden. A more attractive appearance is thereby provided.

The well 4 is located eccentrically near one corner of the base and comprises a tubular sleeve which extends vertically downwardly from the upper surface 1*a* of the base. An annular flange 4*a* at the upper end of the sleeve rests on the upper surface of the base. Intermediate the upper and lower ends of the sleeve forming the well 4 an abutment surface in the form of a pin 6 projects radially inwardly a short distance. The pin may, for example, be inserted through a hole drilled in one side of the sleeve and welded in place.

The table top 1 is shown by way of example in the drawings as being appoximately square and slightly larger in plan view than the base 1. The post 3 by which the table top is supported is shown as a tubular sleeve which fits telescopically inside the tubular sleeve forming the well 4 in the base so as to be rotatable and longitudinally slidable therein. The upper end of the post 3 is secured to the underside of the table top 2 at an eccentric location so as to be near one corner. The location of the post 3 corresponds to that of the well 4 so that when the table top is in the position shown in solid lines in FIG. 1 it is centered relative to the base 1. The post 3 is secured to the table top 1 in any suitable manner so as to provide a strong connection. By way of example the post 3 is shown provided at its upper end with a flange 3*a* which can be welded to the table top 2 if the latter is formed of metal or can be secured by other means, for example bolts or screws, if the table top is formed of other material such as wood, marble or plastic.

In order to support the table top 2 at different heights, the post 3 is provided at different levels with abutment surfaces which cooperate with the abutment surface provided by the pin 6 in the well 4. For supporting the table top 2 at its lowest level, the post 3 is provided with a slot 3*b* extending up from the lower end of the sleeve that forms the post. The slot 3*b* is of a width to receive the pin 6 and extends upwardly from the lower end of the post 3 so that the pin 6 engages the upper end of the slot 3*b* to support the table top in its lowermost position in which it is spaced a selected distance from the upper surface 1*a* of the base 1 as shown in solid lines in FIG. 2 and designated L1. In this position the table top is centered relative to the base and is held against rotation by engagement of the pin 6 in the slot 3*b* of the post 3.

Figure 2:
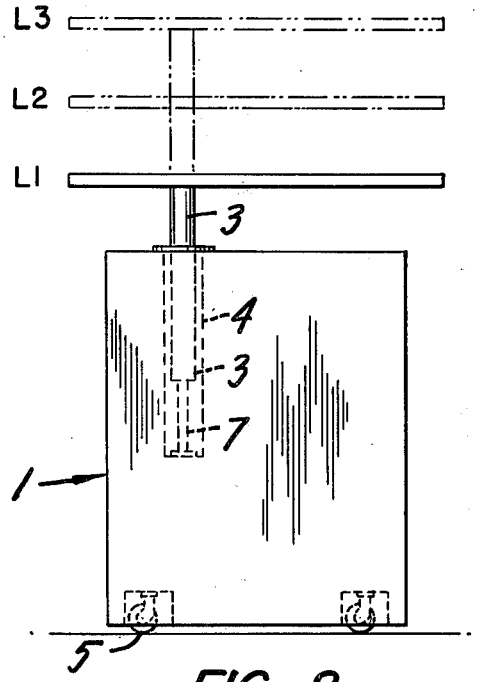
FIG. 2 is a side elevation of the table with the table top shown at one level in solid lines and another level with broken lines.
Figure 3:
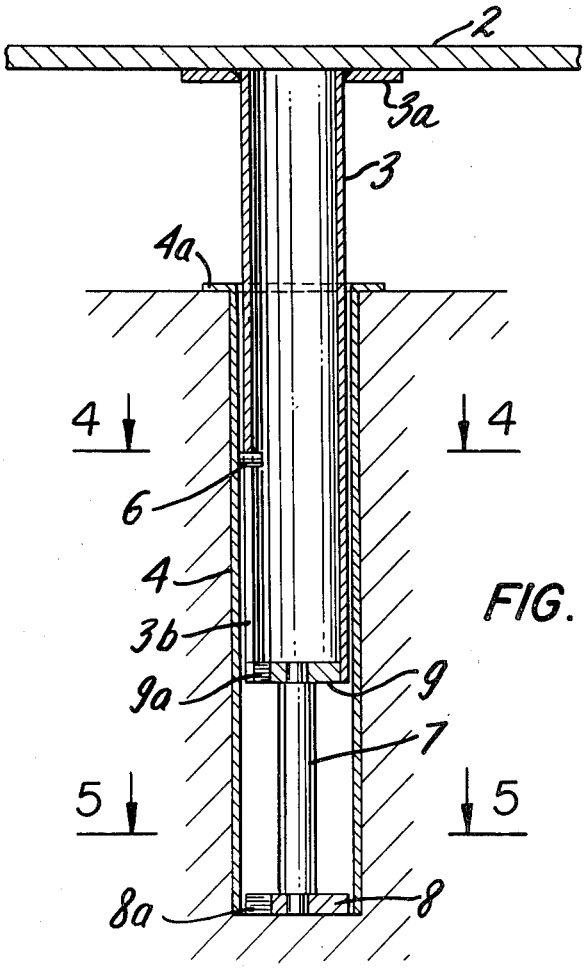
FIG. 3 is a partial vertical section illustrating the mounting of the table top on the base.
Figure 4:
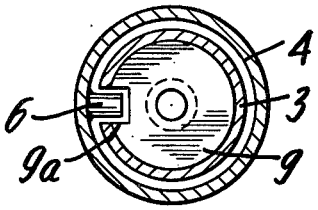
FIGS. 4 and 5 are partial cross sections taken respectively on the lines 4—4 and 5—5 of FIG. 3.
Figure 5:
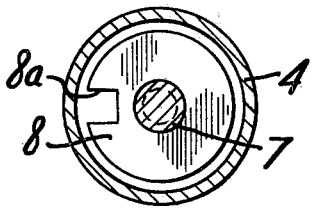
Figure 6:
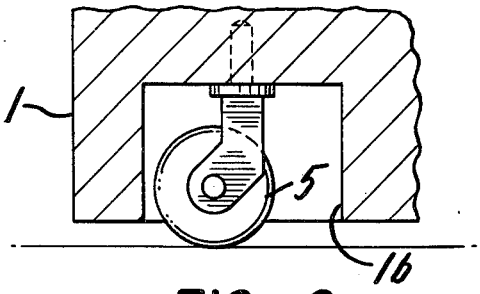
FIG. 6 is a partial vertical section showing the provision of casters to support the base.

The table top 2 is supported at a second level L2 as shown in broken lines in FIG. 2 by engagement of the pin 6 in the well 4 with the lower end of the tubular sleeve which forms the post 3. In order to position the table top in the position L2, the table top is raised so as to bring the lower end of the post 3 above the pin 6 and is then turned so that the slot 3*b* is out of register with the pin 6. The table top is thereupon supported at the level L2 by engagement of the pin 6 with the lower end of the post 3. At this level the table top can be turned through 360° to any selected angular position as shown for example by broken lines in FIG. 1 except, of course, a position centered with respect to the base since in this position the table top would not be supported but would be lowered to level L1. The table top is held in selected angular position by frictional engagement of the pin 6 with the lower end of the post.

To support the table top 2 at a third level L3 as shown in broken lines in FIG. 2, the post 3 is provided with a downard extension 7 of reduced diameter at the lower end of which there is fixed a disc 8 of the same diameter as the post 3. The extension 7 is conveniently affixed to the lower end of the sleeve which forms the post 3 by a second disc 9 which is fixed on the upper end of the extension 7 and fits into the lower end of the tubular post 3 to which it is secured for example by welding. The upper disc has a notch 9*a* which registers with the slot 3*b* in the tubular post 3 to permit passage of the pin 6. The lower disc 8 also has a corresponding and aligned notch 8*a*. In order to position the table top at level L3, the table top is positioned angularly so as to be centered with respect to the base and is then raised so that the pin 6 passes through the notch 8*a* of the disc 8 and is positioned below the disc. The table top is then turned so that the notch 8*a* of the disc 8 is out of register with the pin 6 whereupon the disc 8 rests on the pin 6 to support the table top at the level L3. At this level, as at level L2, the table top can be rotated through 360° to selected angular position and is retained in such position by fricitonal engagement of the disc 8 with the pin 6. With the table top at level L3, the lower end of the tubular post 3 is still within the well 4 so that the post 3 is held in alignment with the well 4 by engagement of the post 3 and disc 8 with the inner surface of the sleeve which forms the well. It will be understood that the post 3 fits snugly in the well 4 to avoid undesired play while being readily rotatable and telescopically slidable therein.

In order to lower the table top from level L3 or level L2, the table top is merely turned to a position in which it is centered relative to the base as illustrated by solid lines in FIG. 1.

In FIGS. 7 to 11 there is shown by way of example a coffee table having a base 11 and four table tops 12 each having a post 13 telescopically and rotatably received in a well 14 in the base. The wells 14 and posts 13 with extensions 17 are of the same construction as illustrated in FIGS. 2–5 so that each of the table tops 12 can be positioned at different levels L1, L2 and L3 as described above. When in the lowermost positioned L1, the table tops 12 are positioned over the base 11 as shown in solid lines in FIG. 7. When in raised position L2 or L3, each of the table tops is individually rotatable to a selected angular position in which it overhangs the base as illustrated in broken lines in FIG. 7. The operation of raising, lowering and angularly positioning the table tops is as described above.

The base 11 of the table illustrated in FIGS. 7 to 11 is shown as being hollow to provide a storage space therein. The hollow base is conveniently fabricated of metal plate but can alternatively be made of other material. The base is shown as having a bottom 11*a* supported by flanges 11*b* on the side walls. The hollow space within the base is partially closed by top portions 11*c* projecting inwardly from two opposite sides of the base. At the other two sides of the base there are inwardly extending top portions 11*d* provided at their up-turned inner edges with plastic guide rails 20 for two slidable covers 21 provided at opposite ends with down-turned flange portions 21*a* laterally engaging the guide rails 20. The slidable covers 20 are movable from closed position in which their inner edges meet centrally of the base 11 to open position as illustrated by broken lines in FIG. 7 in which they provide access to the storage space within the base 11 and overhang opposite sides of the base to provide extending supporting surfaces or shelves supplementing the supporting surfaces of the table tops 12. Near their inner edges the covers 21 are provided on their undersides with L-shaped hook portions 21*b* which hook under the inner edges of opposite top portions 11*c* of the base to limit outward movement of the covers and also prevent the covers from tipping downwardly.

Figure 7:
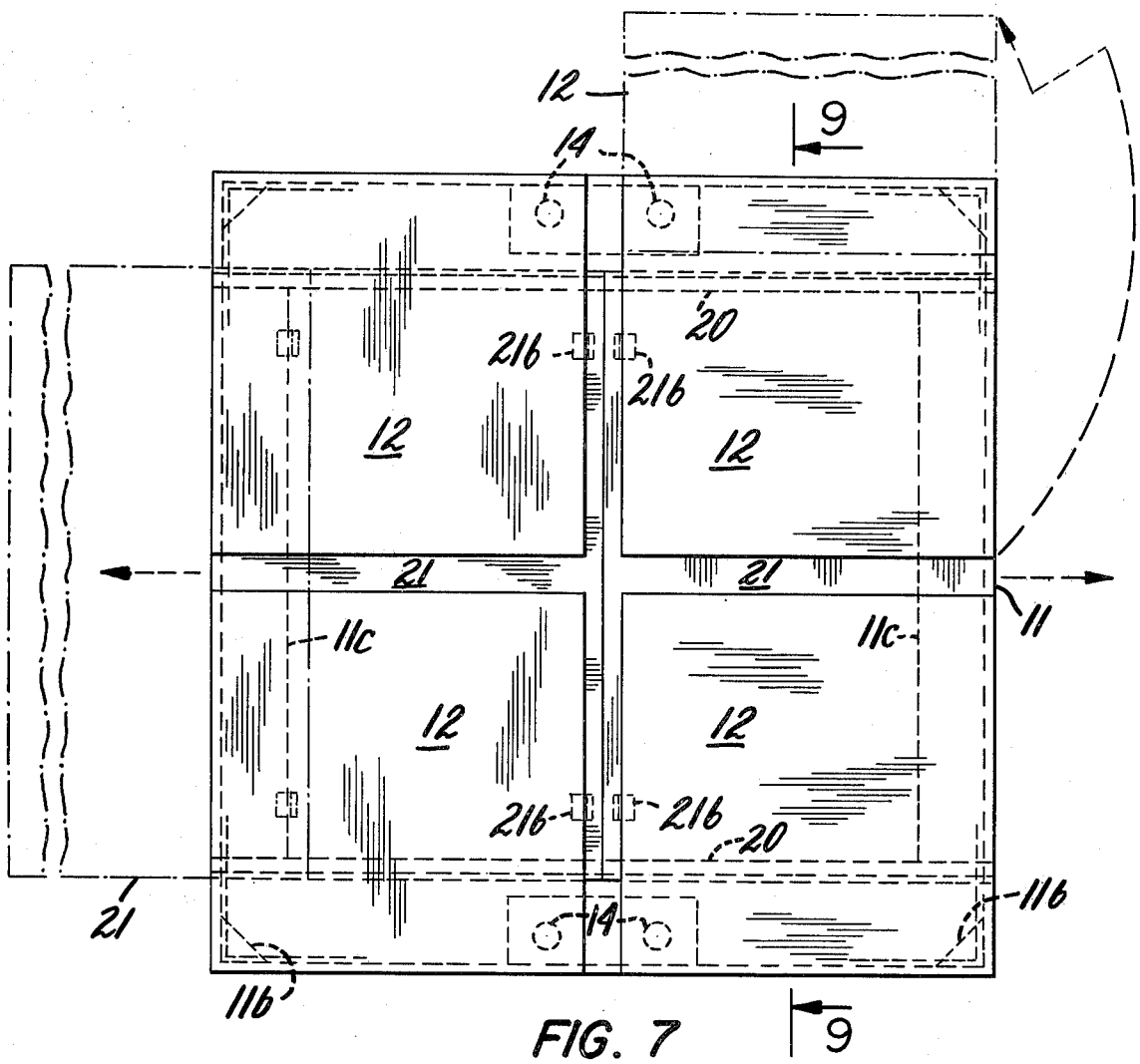
FIG. 7 is a plan view of a coffee table in accordance with the invention having a base and four table tops.
Figure 8:
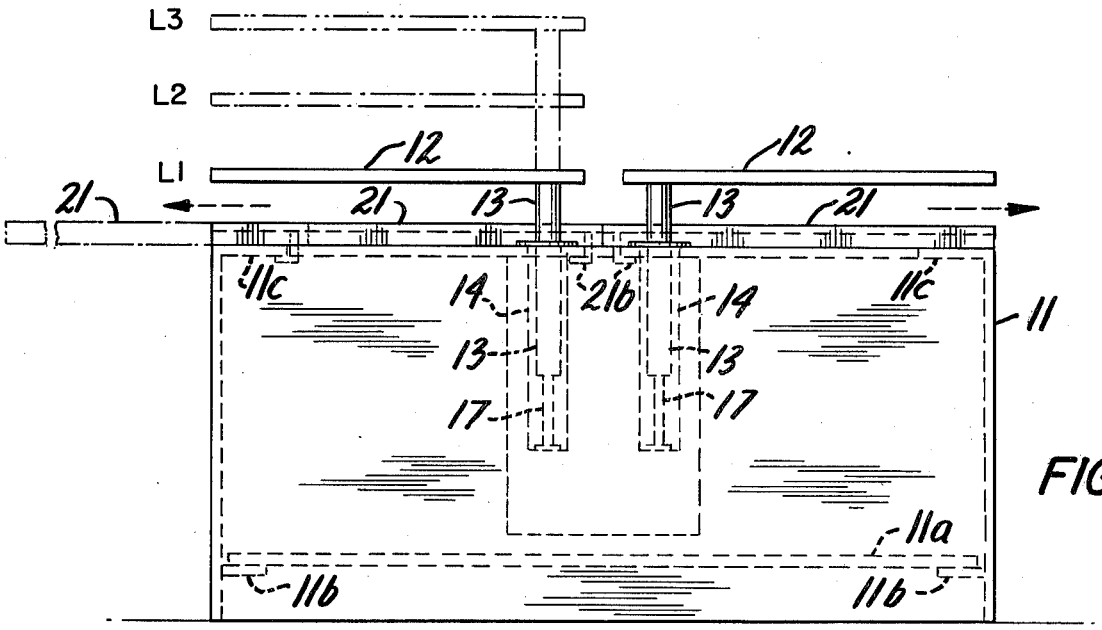
FIG. 8 is a side elevation of the table shown in FIG. 7.

As will be seen in FIG. 7, the posts 13 are located eccentrically near the corners of the rectangular table tops 12 and the wells 14 in the base 11 for receiving the post 13 are located eccentrically of the base near opposite side walls and on opposite sides of a center line of the base. When the table tops are at the lower level L1 they overlie the base and are located close to one another as illustrated in FIG. 7. When at level L2 or L3 each of the table tops can be swung to selected angular position in which it overhangs the base. It will be understood that each of the tabel tops 12 can be individually positioned as desired at selected level and in selected angular position. Thus the table tops can be arranged at different levels and in different angular position.

A modification is illustrated in FIGS. 12 and 13 of which FIG. 12 is a horizontal section taken on the line 12—12 in FIG. 13 and FIG. 13 is a partial vertical section. As illustrated in FIGS. 12 and 13, a disc 22 of flexible material such as plastic, leather or rubber is secured to the lower face of the disc 8, for example by adhesive. The flexible disc 22 fits snugly inside the well 4 so that the disc 8 together with the flexible disc 22 in effect act as the piston of a pump. Hence, in the event the table top when in raised condition is turned so that the pin 6 is in register with the slot 3*b* of the post 3 and the notch 8*a* of the disc 8, sudden dropping of the table top is prevented by the compression of air in the well 4 below the disc 22. Downward movement of the table top is thus cushioned but controlled movement is permitted by leakage of air past the periphery of the disc 22 and through a slit 23 which is provided in the disc 22 in alignment with the notch 8*a* of the disc 8 in order to permit passage of the pin 6. The safety feature contributed by the disc 22 is applicable to the embodiment of the invention shown in FIGS. 1 to 6 and also that shown in FIGS. 7 to 11.

While preferred embodiments of the invention have been illustrated in the drawings and are herein particularly described, it will be understood that many variations and modifications may be made and that the invention is hence in no way limited to the illustrated embodiments.

What I claim is:

1. A table comprising a base having a vertical well of circular cross section located eccentrically of the base, and a table top having an eccentrically located, downwardly extending supporting post rotatably received in said well and longitudinally slidable therein, one of said post or well having a plurality of abutment surfaces arranged at different levels and a vertical channel connecting said abutment surfaces, at least one of said abutment surfaces being an annular surface extending 360° except for the width of said vertical channel, and the other of said post or well having a fixed radial pin slidably received in said vertical channel for raising and lowering said table top bewteen different levels and selectably engageable with said abutment surfaces to support said table top at different levels, whereby said table top, when supported at a selected level by engagement of said pin with said annular abutment surface, can be turned 360° except for the width of said vertical channel, and when turned to bring said pin into alignment with said vertical channel, can be raised or lowered to a different level.

2. A table according to claim 1, in which said base is a rectangular prism and said table top is rectangular, and in which said well and post are located near a corner of said base and table top respectively.

3. A table according to claim 2, in which said table top in one angular position is directly above said base and in other angular positions overhangs said base.

4. A table comprising a prismatic base having a plurality of vertical wells of circular cross section located near its perimeter and a corresponding plurality of table tops each having an eccentrically located, downwardly extending supporting post rotatably received in a respective well in said base and longitudinally slidable therein, each of said posts having a plurality of abutment surfaces at different levels and a vertical channel connecting said abutment surfaces, at least one of abutment surfaces being an annular surface extending 360° except for the width of said vertical channel, and the respective well having a fixed inwardly projecting radial pin slidably received in said vertical channel for raising and lowering the respective table top between different levels and selectably engageable with said abutment surfaces to support said table top at different levels, whereby said table top, when supported at a selected level by engagement of said pin with said annular abutment surface, can be turned 360° except for the width of said vertical channel, and when turned to bring said pin into alignment with said vertical channel, can be raised or lowered to a different level.

5. A table according to claim 4, in which said base is rectangular and has a pair of said wells adjacent opposite sides, and in which there are four table tops having posts received respectively in said wells of the base.

6. A table according to claim 4, in which said base is hollow to provide storage space and has at the top thereof a slidable cover.

7. A table according to claim 1, in which said pin is in alignment with said vertical channel when said table top is directly above said base, whereby said table top can be raised or lowered only when said table top is directly above said base.

8. A table according to claim 7, in which said pin is out of alignment with said annular abutment surface when said table top is at its lowest vertical position, whereby said table top when in its lowest vertical position is held in a fixed angular position directly above said base by engagement of said pin in said vertical channel.

9. A table according to claim 1, in which said pin is fixed in a wall of said well and projects inwardly, and in which said annular abutment surface is on said post and said vertical channel comprises a channel in said post joining said annular abutment surface.

10. A table according to claim 9, further comprising a fixed stem of reduced diameter extending downwardly from the lower end of said post, a circular abutment member fixed on said stem spaced from the lower end of said post and of the same diameter of said post, with a further annular abutment on said abutment member engageable by said pin to support said table top at a further level and a notch in the periphery of said abutment member forming a channel for passage of said pin, said further annular abutment surface extending 360° except for the width of said notch.

11. A table according to claim 9, further comprising a disc of flexible material secured to the lower end of said post, said flexible disc snugly fitting in said well and acting as a pump piston to cushion downward movement of said table top by compression of air in a lower portion of said well and having a slit permitting passage of said pin past said disc.

12. A table comprising a prismatic base having a vertical well of circular cross section located eccentrically of the base, and a table top having an eccentrically located, downwardly extending supporting post rotatably received in said well and longitudinally slidable therein, one of said post or well having a plurality of annular abutment surfaces arranged at different levels and a vertical passageway between said abutment surfaces, said annular abutment surfaces extending 360° except for the width of said vertical passageway, and the other of said post or well having a fixed radial pin slidably received in said vertical passageway for raising and lowering said table top between different levels and engageable with said annular abutment surfaces to support said table top at different levels whereby said table top when supported engagement of said pin with one of said annular abutment surfaces can be turned 360° except for the width of said vertical passageway, and when turned to bring said pin into alignment with said vertical passageway, can be raised or lowered to a different level.

13. A table according to claim 12, in which said table top when in its lowest vertical position is supported by engagement of said pin with an end of said vertical passageway, said pin in this position being out of alignment with said annular abutment surfaces, whereby said table top when in its lowest vertical position is held in a fixed angular position directly above said base by engagement of said pin in said vertical passageway.

* * * * *